United States Patent [19]

Friebe, deceased et al.

[11] 4,192,479

[45] Mar. 11, 1980

[54] MINE PROP CONSTRUCTION

[76] Inventors: Herbert Friebe, deceased, late of Cologne, Fed. Rep. of Germany; by Axel Rodert, administrator, Haydnstr. 3, Cologne, Fed. Rep. of Germany; Ulrich Reininghaus, Alte Kölner Str. 24, 3

[21] Appl. No.: 946,584

[22] Filed: Sep. 28, 1978

Related U.S. Application Data

[63] Continuation of Ser. No. 830,037, Sep. 2, 1977, abandoned.

[30] Foreign Application Priority Data

Sep. 7, 1976 [DE] Fed. Rep. of Germany ..... 2640104

[51] Int. Cl.[2] ..... E04G 25/04

[52] U.S. Cl. ..... 248/354 H; 52/632; 138/143; 29/455 LM; 428/651

[58] Field of Search ..... 428/651–653, 428/622; 138/143, 177; 248/354 H; 29/455 LM; 52/632

[56] References Cited

U.S. PATENT DOCUMENTS

| | | | |
|---|---|---|---|
| 58,650 | 10/1866 | King | 29/447 |
| 1,467,563 | 9/1923 | Armstrong | 138/143 |
| 2,311,138 | 2/1943 | Swartz | 138/143 |
| 2,585,128 | 2/1952 | Howe et al. | 204/38 A |
| 2,647,847 | 8/1953 | Black et al. | 29/447 |
| 3,031,330 | 4/1962 | Hornick et al. | 428/653 |
| 3,086,284 | 4/1963 | Schetky | 428/622 |
| 3,598,156 | 8/1971 | Ulmer et al. | 428/652 |
| 3,689,232 | 9/1972 | Baba et al. | 428/651 |
| 3,942,705 | 3/1976 | Barbay | 427/433 |

FOREIGN PATENT DOCUMENTS

| | | | |
|---|---|---|---|
| 1202536 | 7/1959 | France | 248/354 A |

*Primary Examiner*—James L. Ridgill, Jr.
*Attorney, Agent, or Firm*—McGlew and Tuttle

[57] ABSTRACT

A hydraulically operated mine prop made of light metal, comprises an outer prop portion and at least one telescopic inner portion with at least one of these portions being provided with a non-sparking and impact-resistant metal covering. The covering may, for example, comprise steel, and an insulating layer is advantageously provided between the covering and the prop portion with which it is associated. The thickness of the covering is advantageously made from 0.2 mm to 0.6 mm.

11 Claims, 3 Drawing Figures

MINE PROP CONSTRUCTION

This is a continuation of application Ser. No. 830,037 filed Sept. 2, 1977, now abandoned.

FIELD AND BACKGROUND OF THE INVENTION

The present invention relates in general to underground mining equipment and, in particular, to a new and useful hydraulic mine prop of light metal, comprising an outer prop and one or more telescoping inner props.

DESCRIPTION OF THE PRIOR ART

Mine props of aluminum which can be advantageously employed underground because of their relatively low weight have the drawback that they are capable of producing sparks upon impact and, thus, the safety of underground mining may be endangered. Although attempts have been made to provide aluminum props with electrodeposits, chemical or anodic coatings, with the striking energies occurring underground, such coatings are not capable of preventing the production of spraks resulting from an impact on the light metal. Similar problems arise from the high edge forces which are produced in the area of the guide sleeve between the outer and inner props and which may occur following an eccentric load distribution in the prop.

It is further known to coat the aluminum prop with a plastic. This, however, results in problems of resistance to impacts and again of sparking and, in addition, of the basic usefulness of coating the inner props.

In German Patent No. 808,225, it has also been provided to protect the outer prop against damages by an outer rubber layer. This, however, has been applied to props made of steel and the protection has been provided not against sparking, but against damaging and deformation. Here again also, the inner props cannot be provided with a rubber layer. The problems with the application of a rubber layer to aluminum props are analogous to coating with plastic.

SUMMARY OF THE INVENTION

The present invention is directed to a mine prop which is safe against sparking and has a surface which is sufficiently resistant to prevent the light metal, of which the prop is made, from being exposed either by impacts, edge forces, or the like, or by the telescoping motion of the inner props.

In accordance with the invention, the inner and/or outer prop is provided with an impact-resistant jacket of a metal which does not produce sparks. For this purpose, the material is a steel which is, for example, galvanized steel, copper alloys, such as bronze, brass, as well as chromium-nickel alloys, particularly high-grade steel, but also titanium and titanium alloys, which are sufficiently tough so that they cannot be broken down. The covering is as thin as possible for reasons of costs and weight. According to the present usual testing methods in mining, and with the use of tubes of metal which are impact-resistant, a coating having a thickness of only fragments of millimeters is satisfactory. The thickness of the covering is preferably from 0.2 mm to 0.6 mm.

An insulation may be provided between the covering and the inner or outer prop in order to prevent the formation of an electrically conducting bridge which might lead to corrosion. The insulation consists of, as far as possible, a non-combustible foil of plastic or of such a foil having a high flash point, or, with a covering glued on, it may be formed by an adhesive havng the same properties. Particularly preferable is an anodic oxide layer on the outer surfaces of the inner and outer props, which, as a non-conducting layer, prevents the formation of electrical bridges.

The covering may be applied by gluing, or also by winding, roll coating, or ultrasonic, electron-beam, or laser welding. It is further possible to connect the covering to the inner or outer prop by providing appropriate constructional measures. Particularly preferred is a shrink-fitting of the covering providing a full contact between the covering, the insulating layer and the inner or outer prop. Further, if a covering of rust-proof steel is provided, in view of the high yield point of such material, the wall thickness of the aluminum tube used as the outer or inner prop can be reduced.

Accordingly, it is an object of the invention to provide a hydraulic mine prop made of light metal, comprising an outer prop portion and at least one telescopic inner prop portion, said at least one prop portion being provided with a non-sparking and impact-resistant metal covering.

A further object of the invention is to provide a hydraulic mine prop which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DESCRIPTION OF THE PREFERRED EMBODIMENTS

Figure 1:
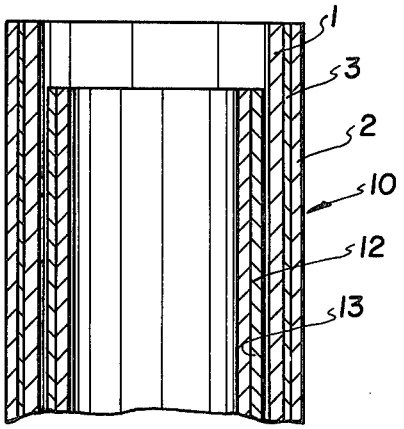
FIG. 1 is a partial sectional view of a first embodiment of a mine prop, constructed in accordance with the invention.

Referring to the drawing in particular, the invention embodied in FIG. 1 therein, comprises a hydraulic mine prop of a light metal, generally designated 10, which includes an outer prop portion 1 and an inner prop portion 12 which is telescopic within the outer prop portion 1. At least one of the outer and inner prop portions 1 and 12 is provided with a coating or covering 3 which is of a non-sparking and impact-resistant metal. The inner prop portion 12 advantageously includes a jacket 13 made of a non-sparking and impact-resistant metal, such as, steel.

In the embodiment of FIG. 1, where a portion of an outer prop 1 formed of a light metal tube is shown in section, the outer circumferential surface of the outer prop 1 is provided with an insulating layer 3 which, for example, may comprise a foil of plastic having a high flash point and, which in turn, is surrounded by a covering 2, which is preferably made of a rust-proof steel and is shrinkfitted thereon. If covering or jacket 2 is glued on, the insulating layer 3 may be formed by the adhesive which is used. In such a case, in order to better prevent the formation of an electrically conducting bridge, the front face of the light metal tube constituting prop 1 may also be coated by the insulating layer 3.

Figure 2:
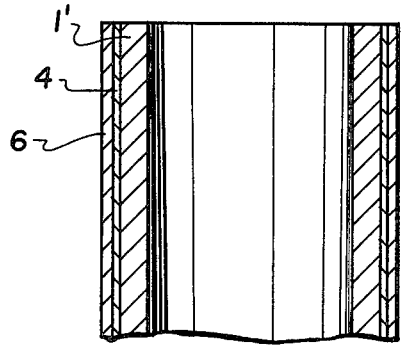
FIG. 2 is a similar view of a second embodiment of the invention, having another insulation.

In the embodiment of FIG. 2, outer prop 1' is provided with an anodic oxide layer 4 on both its inside and outside, as well as on its front face, and the anodic oxide layer 4 on the outside of outer prop 1 is surrounded by a covering 6. Covering 6 may be shrink-fitted thereon, but other methods such as gluing, winding or the like may also be used.

Figure 3:
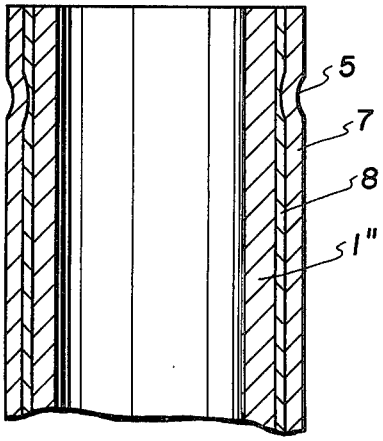
FIG. 3 is a similar view of a third embodiment with a mechanically secured covering.

In the embodiment of FIG. 3, outer prop 1 is provided at its upper as well as at its lower end with a circumferential indentation 5 into which covering 7 is fitted by pressure, so that it is connected to outer prop 1 mechanically. Here again, an insulating layer 8 may be provided between outer prop 1 and covering 2. Other designs based on mechanical connection may also be provided.

While specific embodiments of the invention have been shown and described in detail to illustrate the application of the principles of the invention, it will be understood that the invention may be embodied otherwise without departing from such principles.

What is claimed is:

1. A hydraulic mine prop of aluminum for continuous operation in a mine without hot sparking, comprising an outer tubular prop portion and at least one inner tubular prop portion telescopically arranged in said outer prop portion, said prop portions both being provided with a protective jacket of hard metal on the outer surfaces of both the inner and outer props which is impact-resistant and prevents hot spark formation, said hard metal jacket having a thickness of from about 0.2 mm to 0.6 mm.

2. A hydraulic mine prop, as claimed in claim 1, including a non-combustible plastic insulating layer between said jacket and said associated prop portion.

3. A hydraulic mine prop, as claimed in claim 1, including an adhesive insulation layer with high flash point between said jacket and said prop portion.

4. A hydraulic mine prop, as claimed in claim 1, including an anodic oxide layer between said jacket and said mine prop portion.

5. A hydraulic mine prop, as claimed in claim 1, wherein said jacket comprises a welded high grade steel jacket.

6. A hydraulic mine prop according to claim 1, wherein said hard metal comprises steel.

7. A hydraulic mine prop according to claim 1, wherein said hard metal comprises high grade steel.

8. A hydraulic mine prop according to claim 1, wherein said hard metal comprises titanium.

9. A hydraulic mine prop according to claim 1, wherein said hard metal comprises titanium alloy.

10. A hydraulic mine prop according to claim 1, wherein said protective jacket comprises a high grade steel and/or a titanium or titanium alloy which is sufficiently tough so that it cannot be broken down.

11. A hydraulic mine prop, comprising an outer prop portion and at least one telescoping inner prop portion both made of light metal, at least one of said inner and outer prop portions being provided with a jacket of a non-sparking and impact-resistant metal sheet placed around.

* * * * *